US009359831B2

(12) United States Patent
Bradley et al.

(10) Patent No.: US 9,359,831 B2
(45) Date of Patent: Jun. 7, 2016

(54) TOP DRIVE MAIN SHAFT WITH THREADED LOAD NUT

(71) Applicant: Cameron Rig Solutions, Inc., Houston, TX (US)

(72) Inventors: Richard O. Bradley, Cypress, TX (US); Michael R. Netecke, Houston, TX (US)

(73) Assignee: Cameron Rig Solutions, Inc., Houston, TX (US)

( * ) Notice: Subject to any disclaimer, the term of this patent is extended or adjusted under 35 U.S.C. 154(b) by 255 days.

(21) Appl. No.: 13/840,840

(22) Filed: Mar. 15, 2013

(65) Prior Publication Data

US 2014/0262521 A1 Sep. 18, 2014

(51) Int. Cl.
*E21B 19/16* (2006.01)
*E21B 17/042* (2006.01)

(52) U.S. Cl.
CPC ..... *E21B 17/042* (2013.01); *E21B 19/16* (2013.01)

(58) Field of Classification Search
USPC ..... 175/57, 113, 124
See application file for complete search history.

(56) References Cited

U.S. PATENT DOCUMENTS 3,917,319 A 11/1975 Kloesel et al.
4,981,180 A * 1/1991 Price ..... E21B 3/02 173/164
5,127,784 A 7/1992 Eslinger
7,222,683 B2 5/2007 Folk et al.
7,320,374 B2 1/2008 Folk et al.
2002/0076273 A1 6/2002 Carstensen
2005/0269072 A1 12/2005 Folk et al.
2006/0214421 A1 9/2006 Muradov
2006/0273601 A1* 12/2006 Carstensen ..... 294/91
2007/0240908 A1* 10/2007 Brown ..... E21B 3/02 175/85
2008/0099221 A1 5/2008 Lynch
2010/0122849 A1* 5/2010 Salzer, III ..... E21B 17/1064 175/57
2010/0263934 A1* 10/2010 Nielsen ..... E21B 19/16 175/113
2011/0132594 A1* 6/2011 Slack ..... 166/77.51
2012/0111556 A1 5/2012 Palmer et al.
2012/0273232 A1* 11/2012 O'Blenes ..... E21B 3/02 166/380

FOREIGN PATENT DOCUMENTS

WO 2012161641 11/2012

OTHER PUBLICATIONS

Copenheaver, International Search Report and Written Opinion for PCT/US2014/025849, mailed Jul. 18, 2014.

* cited by examiner

*Primary Examiner* — Taras P Bemko
(74) *Attorney, Agent, or Firm* — Eubanks PLLC

(57) ABSTRACT

A top drive system is provided. In one embodiment, a top drive includes a drive stem and a load nut with mating threaded surfaces that enable the drive stem to be threaded through the load nut and to support weight of a connected drill string via the load nut. One or both of the mating threaded surfaces may have a threadform with one or more undercut thread roots. Additionally, a portion of the mating threaded surfaces, such as thread roots of the drive stem, can be shot-peened. Additional systems, devices, and methods are also disclosed.

16 Claims, 7 Drawing Sheets

TOP DRIVE MAIN SHAFT WITH THREADED LOAD NUT

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Whether onshore or offshore, a drilling rig can be provided to drill a well to access the desired resource. A drill string can be suspended from the drilling rig and rotated to drill the well. While the drill string can be suspended from a kelly and driven by a rotary table on the drill floor of the drilling rig, in some instances the drill string is instead suspended from and driven by a top drive of the drilling rig. Such a top drive generally includes a drive stem (also referred to as a main shaft) that can be connected to the drill string. A motor in the top drive is connected to the drive stem to drive rotation of the drill string via the drive stem. The top drive can be raised and lowered via a hoisting system to raise and lower the drill string within the well.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a top drive having a drive stem with a threaded surface for engaging a threaded load nut. In one embodiment, a top drive includes a load nut and a drive stem that have mating threaded surfaces such that one or more other components of the top drive can be suspended from the drive stem via the load nut. In some instances, a drill string can be suspended from the one or more other components such that the weight of the drill string and the one or more other components cause the load nut to load against the drive stem via the mating threaded surfaces. In at least one embodiment, a portion of one or both of the mating threaded surfaces of the load nut and the drive stem (e.g., one or more thread roots of the drive stem) is shot-peened to increase its load capability. Also, the threadform of one or both of the mating threaded surfaces can include thread roots that are undercut.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom,"

"above," "below," other directional terms, and variations of these terms is made for convenience, but does not require any particular orientation of the components.

Figure 1:
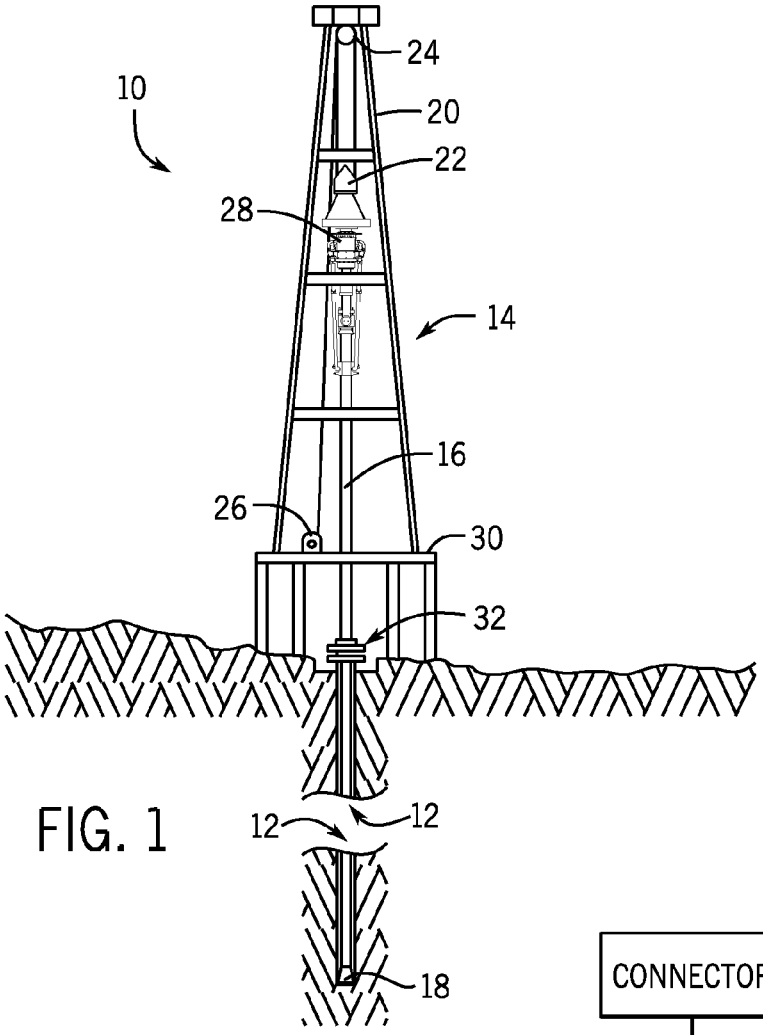
FIG. 1 generally depicts a drilling system having a top drive in accordance with an embodiment of the present disclosure.

Turning now to the present figures, a drilling system 10 is illustrated in FIG. 1 in accordance with one embodiment. Notably, the system 10 may be operated to drill a well 12 to access a subterranean resource, such as oil or natural gas. As depicted, the system 10 includes an onshore drilling rig 14, although the system 10 could instead be an offshore system in other embodiments. The drilling rig 14 uses a drill string 16 and a drill bit 18 to form the well 12. It will be appreciated that the drill string 16 can include various members, such as drill pipes, tool joints, drill collars, and a saver sub that prevents wear on a threaded connection of a rotating system (e.g., a top drive) that drives rotation of the drill string 16.

The drilling rig 14 also includes a mast 20 and a hoisting system (here generally shown as including a traveling block 22, a crown block 24, and drawworks 26) to enable a top drive 28 to be raised and lowered with respect to a drill floor 30. The drill string 16 is suspended from the top drive 28 through a hole in the drill floor 30 and through surface equipment (e.g., a blowout preventer 32 in the cellar). The drill string 16 can be rotated by the top drive 28 and can be raised and lowered with the top drive 28 (via the traveling block 22) to facilitate drilling operations.

Figure 2:
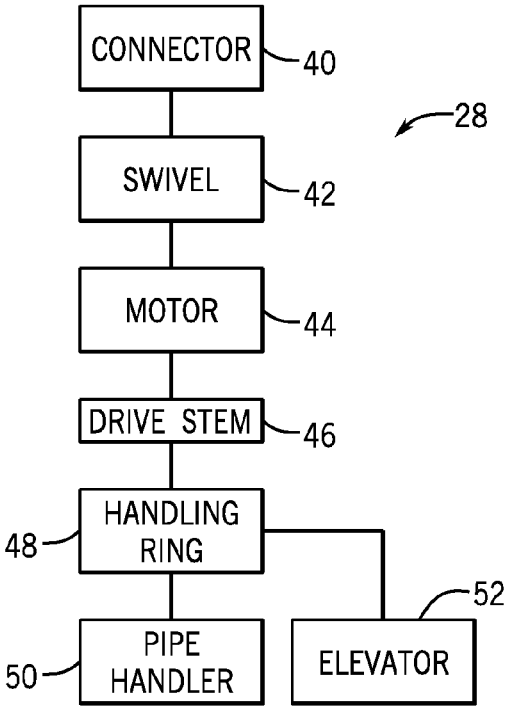
FIG. 2 is a block diagram of various components of a top drive in accordance with one embodiment.

One example of a top drive 28 is generally depicted in FIG. 2. In this embodiment, the top drive 28 includes a connector 40 for attaching the top drive 28 to the traveling block 22. A drive stem 46 is suspended from a swivel 42 through a motor 44, which drives rotation of the drive stem 46 within the top drive 28. The drive stem 46 (which is sometimes referred to as a main shaft or a quill) can be connected to a drill string 16 to cause the drill string 16 to rotate along with the drive stem 46. The top drive 28 of FIG. 2 also includes a handling ring 48 connected to a pipe handler 50 and to an elevator 52.

Figure 3:
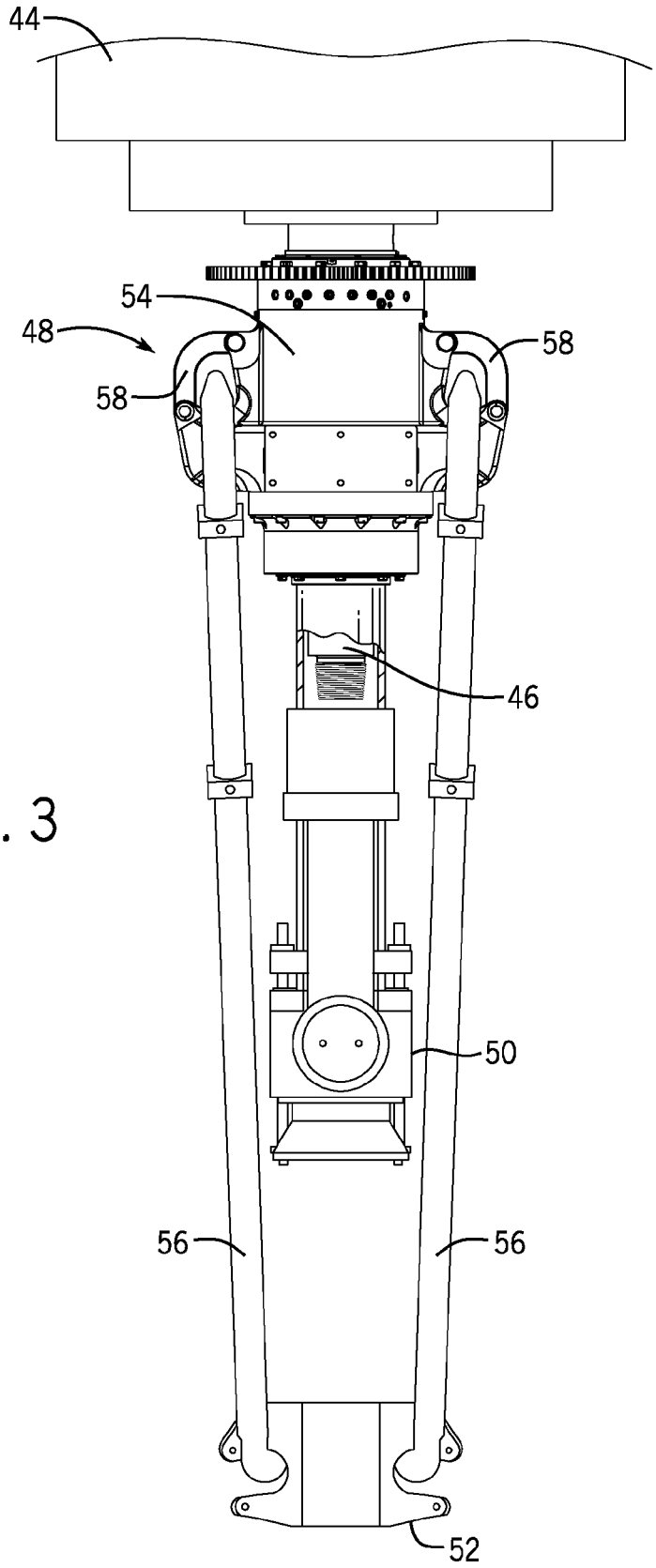
FIG. 3 is a front elevational view of certain components of a top drive, including a handling ring, a pipe handler, and an elevator, in accordance with one embodiment.

As shown in FIG. 3 by way of example, the pipe handler 50 can be connected below a main body 54 of the handling ring 48, and the elevator 52 can be connected to the handling ring 48 via links 56. The links 56, which are retained with the main body 54 of the handling ring 48 by arms 58, can include linear actuators (e.g., hydraulic cylinders) to enable raising and lowering of the elevator 52 with respect to the pipe handler 50. In operation, the elevator 52 can grip a drill pipe (or a stand of drill pipes) and raise the drill pipe into the pipe handler 50. This drill pipe may then be rotated by the pipe handler 50 to connect the drill pipe to the drive stem 46. In some embodiments, connecting the drill pipe to the drive stem 46 includes threading the drill pipe onto an intermediate component (e.g., a saver sub) connected to the drive stem 46. Such an arrangement can be used to reduce wear on the threaded end of the drive stem 46. But in other embodiments, the drill pipe could be connected directly to the drive stem 46. Once connected to the drive stem 46, the drill pipe can be added to the drill string 16 (e.g., by lowering the drill pipe and threading it into the rest of the drill string 16). And in other instances, the elevator 52 can grip the top of the drill string 16 to allow the elevator to raise or lower the drill string (e.g., into engagement with the drive stem 46 or a saver sub connected to the drive stem).

A handling ring can include various internal components that enable the weight of the handling ring, the elevator, and the pipe handler, as well as other components connected thereto (such as a drill string), to be supported by a drive stem. In some previous top drives, a handling ring included load collars having multiple, concentric "fingers" provided along the inner bores of the load collars. The fingers of a load collar could interlock with mating grooves on a drive stem to support the weight of the handling ring (and of any equipment suspended from the handling ring, such as a drill string via an elevator or a pipe handler). The load collar could be split into two pieces to facilitate connection of the load collar about the drive stem. In at least some of these previous arrangements, the load collar is retained on the drive stem by a locking hub assembled about the load collar segments with an interference fit. Particularly, the locking hub could be shrink-fitted to the load collar segments by heating the locking hub (causing thermal expansion), installing it on the load collar segments, and then allowing it to cool (resulting in thermal contraction).

Figure 4:
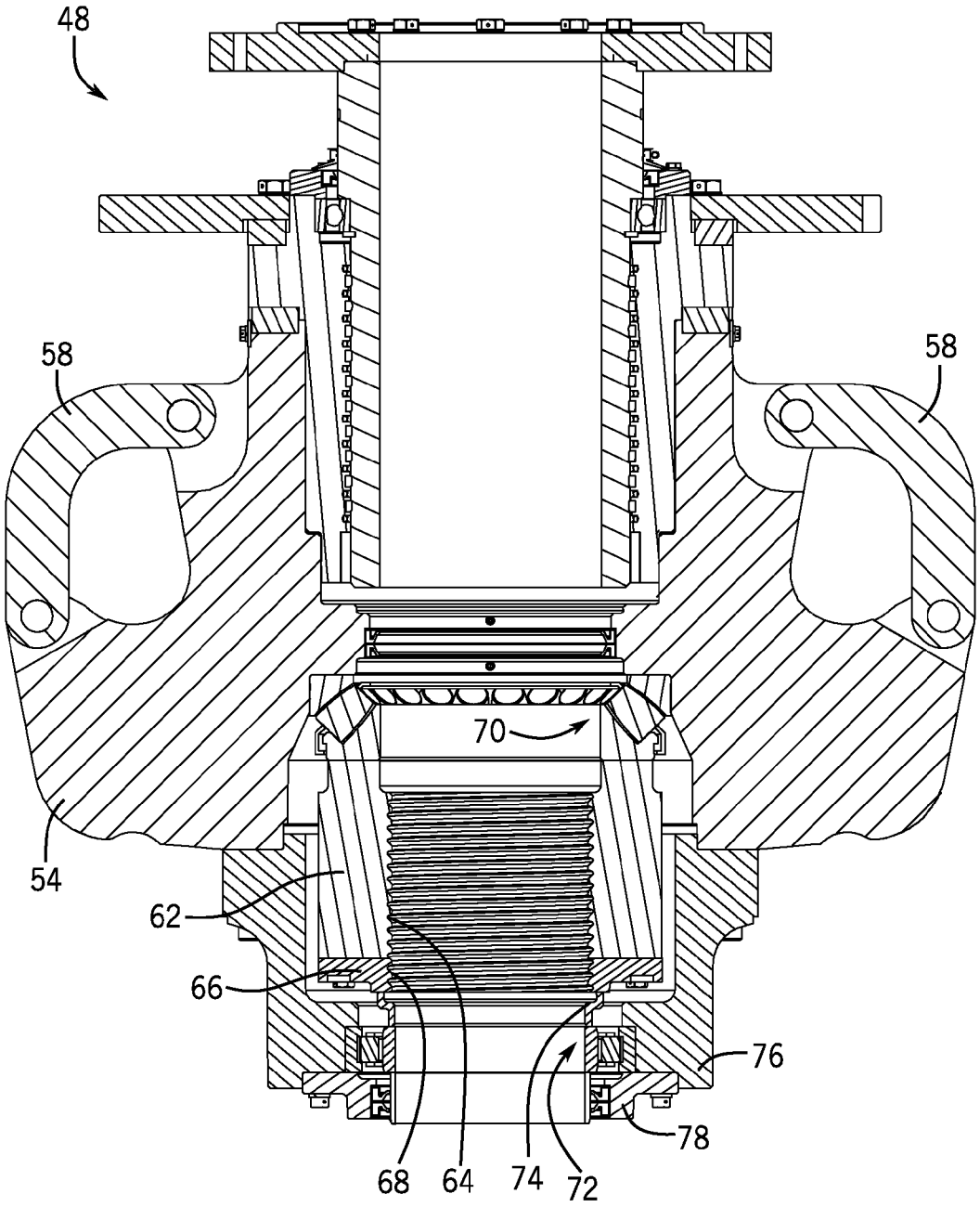
FIG. 4 is a cross-section of the handling ring depicted in FIG. 3, which shows a load nut for receiving a drive stem of the top drive in accordance with one embodiment.

But in at least some embodiments of the present technique, the handling ring 48 includes a threaded surface, such as a threaded load nut, rather than a load collar with fingers. One example of such an embodiment is provided in FIG. 4, in which the handling ring 48 includes a load nut 62 for supporting the main body 54 of the handling ring 48 and loading against the drive stem 46 (e.g., from weight of the handling ring 48 and components suspended directly or indirectly from the handling ring). Although certain components are depicted in FIG. 4 and described below, it will be appreciated that the handling ring 48 could include other components in addition to or instead of those presently depicted. And because the handling ring 48 is supported in the top drive by a threaded connection between the load nut 62 and the drive stem 46, rather than by a load collar assembled with an interference fit, it may be easier for an operator to assemble and disassemble the top drive of the presently disclosed embodiments.

The load nut 62 includes a threaded surface 64 that allows the load nut 62 to engage a mating threaded surface of the drive stem 46. The connection between these mating threaded surfaces enables the load nut 62 to load against the drive stem 46. A retaining ring 66 is shown as fastened to the load nut 62 and includes a threaded surface 68 that allows the retaining ring 66 to also engage the mating threaded surface of the drive stem 46. Bearings 70 and 72 permit rotation of the load nut 62 and the retaining ring 66 with the drive stem 46. The handling ring 48 also includes a spacer 74 for separating the retaining ring 66 from the bearing 72. The load nut 62, the retaining ring 66, and other components are enclosed within the handling ring 48 by a carrier 76 fastened to the main body 54 and a retaining ring 78 fastened to the carrier 76.

Figure 5A:
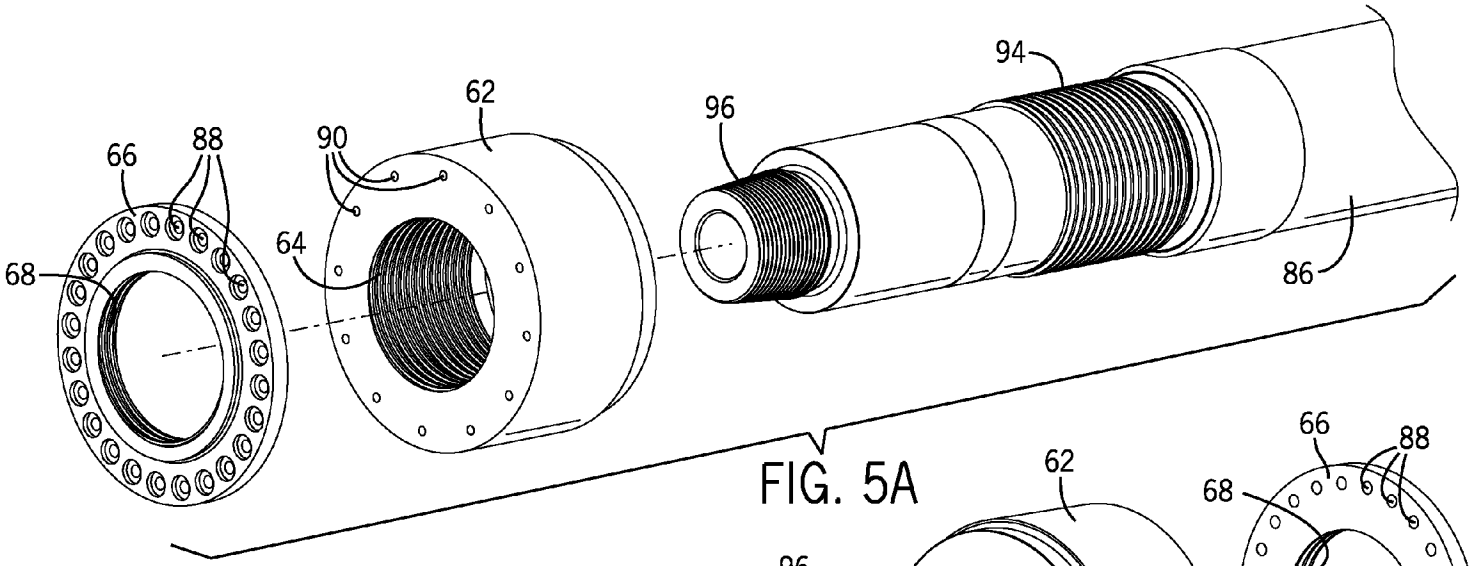
FIGS. 5A and 5B are exploded views of a drive stem of a top drive with a threaded surface for engaging the load nut of FIG. 4 and a retaining ring in accordance with one embodiment.
Figure 5B:
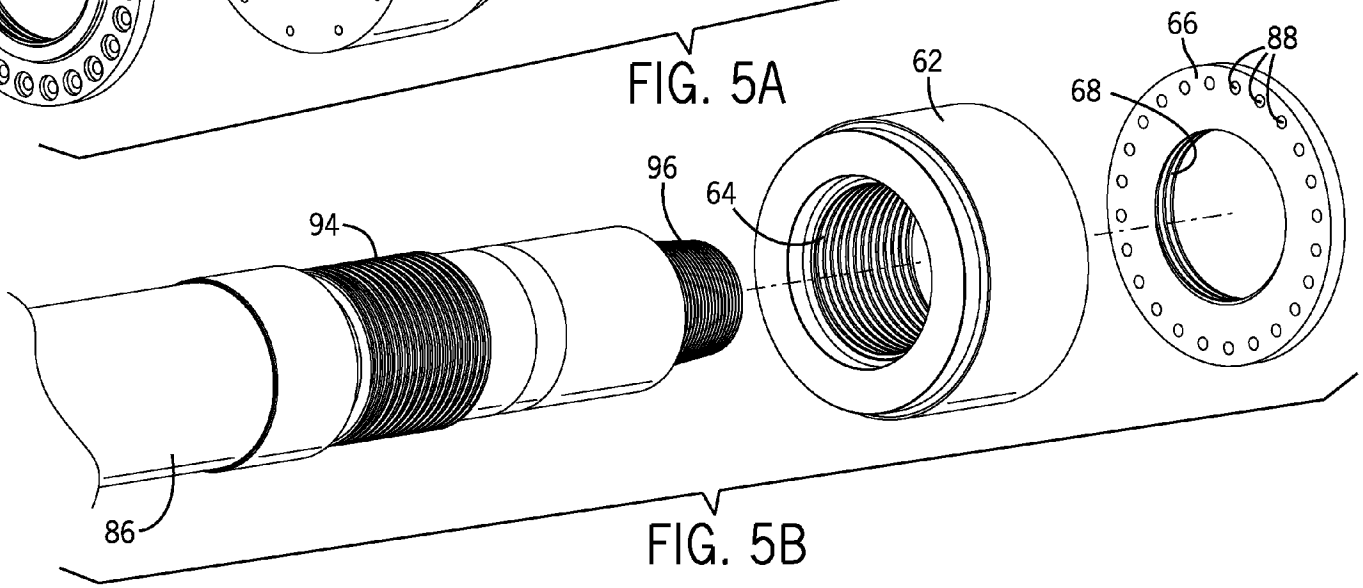

Exploded views of the load nut 62, the retaining ring 66, and a drive stem 86 are provided in FIGS. 5A and 5B by way of example. The drive stem 86 is provided as one example of the drive stem 46, though the drive stem 46 may take other forms in different embodiments. As depicted, the retaining ring 66 includes attachment holes 88 and the load nut includes attachment recesses 90. The holes 88 and recesses 90 allow the use of fasteners (e.g., bolts) to connect the retaining ring 66 to the load nut 62. The drive stem includes a threaded surface 94 that mates with the threaded surfaces 64 and 68 of the load nut 62 and the retaining ring 66, as well as a threaded surface 96 (e.g., an American Petroleum Institute (API) rotary shouldered thread connection) that enables the drive stem 86 to be connected to other components, such as the drill string 16. For assembly, the handling ring 48 can be installed about the drive stem 46. The load nut 62 can then be threaded onto the threaded surface 94, followed by the retaining ring 66, such that the drive stem 86 extends through the load nut 62 and the retaining ring 66. An example of the load nut 62 and the retaining ring 66 assembled on the drive stem 86 in this manner is provided in FIG. 6. Once it is threaded onto the drive stem 86, the retaining ring 66 can be fastened to the load nut 62.

Figure 6:
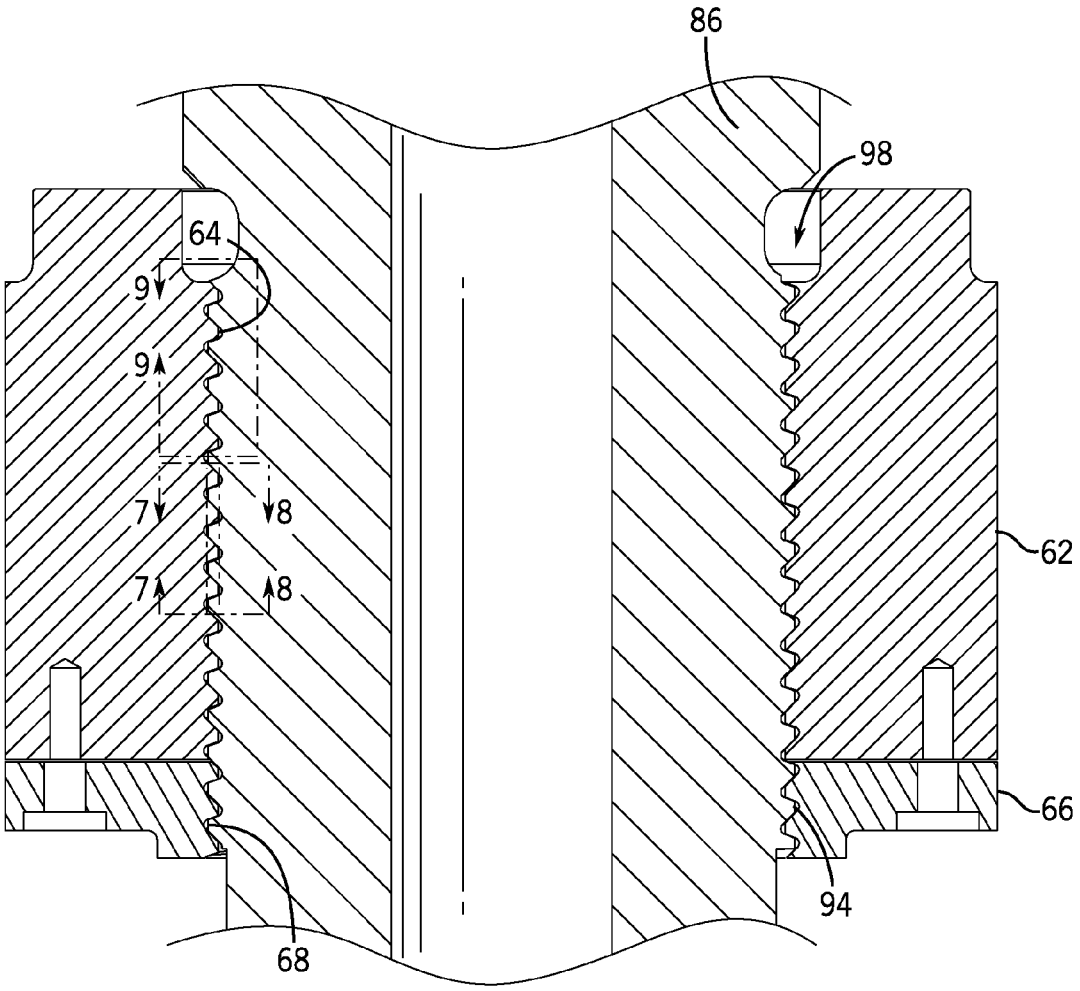
FIG. 6 is cross-section showing the load nut and the retaining ring installed on the threaded surface of the drive stem of FIG. 5 in accordance with one embodiment.

In some embodiments, the number of attachment holes 88 exceeds the number of attachment recesses 90. For example, as depicted in FIG. 5A the retaining ring 66 includes twentyfour holes 88 (radially spaced at fifteen-degree intervals) and the load nut 62 includes twelve recesses 90 (radially spaced at thirty-degree intervals). This accommodates dimensional variation due to stack-up tolerances of the threaded components. Particularly, in one embodiment the load nut 62 can be threaded onto the threaded surface 94 to abut against another component, such as a ring of the bearing 70 or a spacer (not shown) provided within recess 98 (FIG. 6). Once the load nut 62 is seated against the other component, the retaining ring 66 may also be threaded onto the threaded surface 94.

In some instances, rotating the retaining ring 66 along the threaded surface 94 to tightly engage the load nut 62 can result in the attachment holes 88 of the retaining ring 66 not properly aligning with the attachment recesses 90 of the load nut 62 (e.g., due to manufacturing tolerances). In such instances, the retaining ring 66 may be slightly backed off from the load nut 62 on the threaded surface 94 to align the recesses 90 with the holes 88, or with a subset of the holes 88 if there are a greater number of holes 88 than recesses 90. The inclusion of a greater number of holes 88 than recesses 90 reduces the extent to which the retaining ring 66 would have to be backed off from the load nut 62 to achieve alignment and allow fasteners to be inserted in to the recesses 90 through some of the holes 88.

Figure 7:
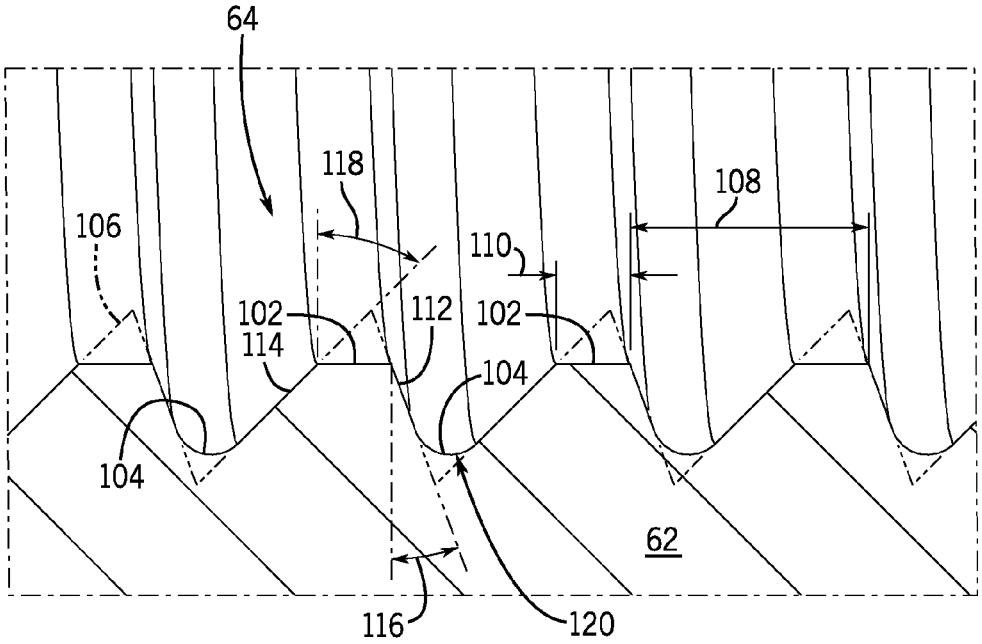
FIG. 7 is a sectional view depicting a threadform of the load nut of FIG. 6 in accordance with one embodiment.
Figure 8:
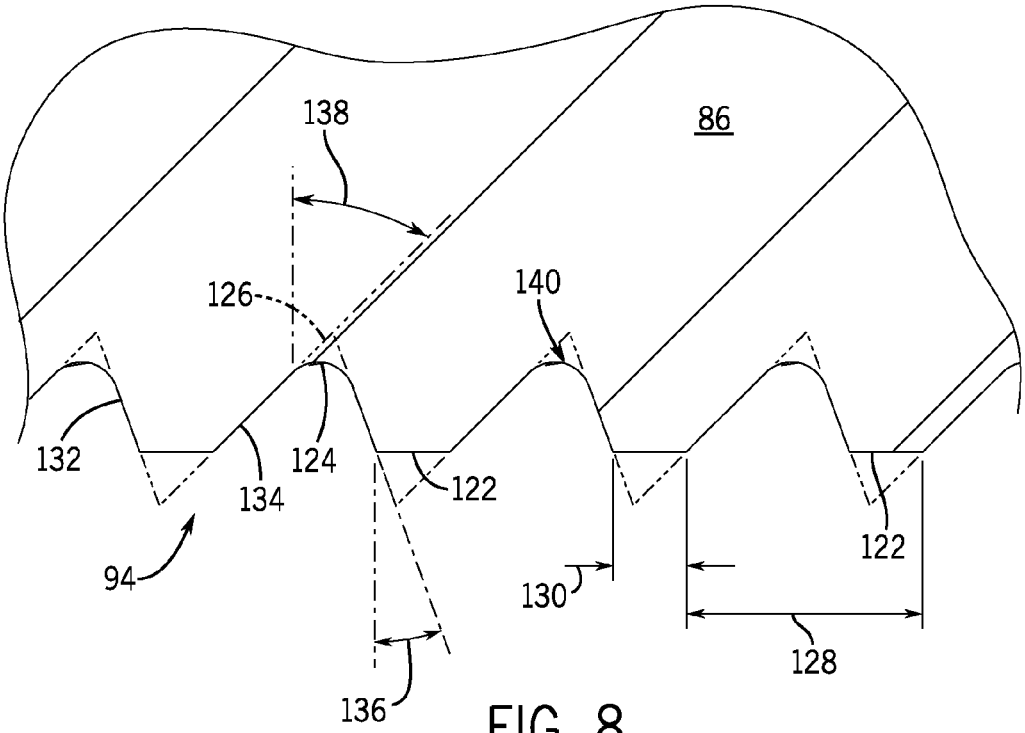
FIG. 8 is a sectional view depicting a threadform of the drive shaft of FIG. 6, which is complementary to that of the load nut depicted in FIG. 7, in accordance with one embodiment.
Figure 9:
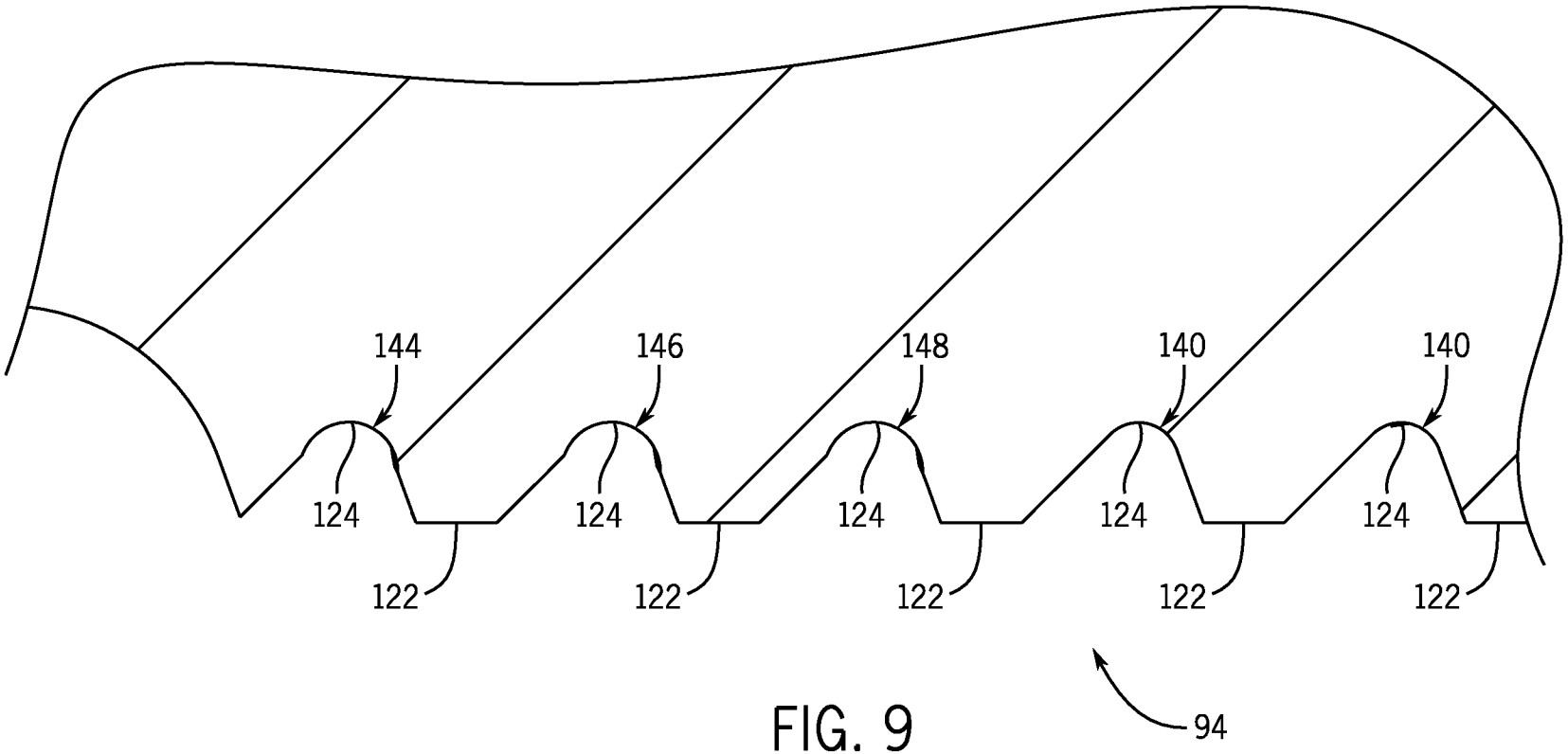
FIG. 9 is a sectional view of a portion of the threaded surface of the drive shaft of FIG. 6, the depicted portion having thread roots that are undercut in accordance with one embodiment.

The mating threaded surfaces 64 and 94 can include any suitable type of threads. For example, these mating threaded surfaces 64 and 94 could include buttress threads in some embodiments. One such embodiment of the threaded surfaces 64 and 94 having buttress threads is generally depicted in FIGS. 7-9. In this example, a cross-section profile of a portion of the threaded surface 64 of the load nut 62 is provided in FIG. 7, while a cross-section profile of a portion of the threaded surface 94 of the drive stem 86 is provided in FIG. 8.

Referring first to FIG. 7, the cross-section of the threaded surface 64 generally depicts a thread having crests 102 and roots 104. It will be appreciated that the crests 102 and roots 104 in the depicted profile (or threadform) can be formed from a single helical thread winding about the inner surface of the load nut 62, or from multiple helical threads. The crests 102 and roots 104 of the threadform are truncated with respect to a sharp thread profile 106, which is generally depicted in FIG. 7 for reference. The depicted threadform includes a pitch 108 and a crest length 110. Flanks 112 and 114 are formed at flank angles 116 and 118 (e.g., twenty degrees and forty-five degrees in one embodiment) with respect to the perpendicular thread axis, and the roots 104 are formed with a root radius 120. The various aspects and dimensions of the threadform can vary between different embodiments.

Turning now to the threaded surface 94 of the drive stem 86, the threadform depicted in FIG. 8 includes features that enable the threaded surface 94 to mate with the threaded surface 64 of FIG. 7. Particularly, the thread profile of the surface 94 includes crests 122 and roots 124, which are truncated from a sharp thread profile 126. As generally noted above with respect to the threaded surface 64, the crests 122 and roots 124 may be formed by a single helical thread (in this case about the exterior of the drive stem 86) or by multiple helical threads. The threadform in FIG. 8 includes a pitch 128 and a crest length 130. Flanks 132 and 134 are formed at flank angles 136 and 138 (e.g., twenty degrees and forty-five degrees in one embodiment) from the perpendicular thread axis, and the roots 124 are formed with a root radius 140.

When installed in the top drive, the threaded surface 64 of the load nut 62 loads against the threaded surface 94 of the drive stem 86 (e.g., through engagement of the thread flanks 112 and 132). The magnitude of stress on these threaded surfaces generally depends on the weight of components, such as the handling ring 48, the pipe handler 50, the elevator 52, and the drill string 16, suspended from the load nut 62. In some embodiments, the threaded surfaces 64 and 94 are modified for greater strength, durability, and loading capabilities. For instance, at least a portion of one or both of the threaded surfaces 64 and 94 is shot-peened in some embodiments. In one particular embodiment, the only portion of the threaded surfaces 64 and 94 that is shot-peened is a subset of thread roots of the threaded surface 94 (e.g., three thread roots at the top of the threaded surface 94 in FIG. 6). Such shot peening can relieve tensile stresses in the load nut 62 and the drive shaft 86 while creating compressive stress that increases the resistance of the threaded surfaces 64 and 94 to fatigue. Subjecting the threaded surfaces 64 and 94 to such a shot-peening process can generally increase the loading capabilities of the surfaces, and may allow the drive stem 86 and the load nut 62 to support more weight (e.g., from a drill string) during operation of the top drive. Other surfaces, such as the threaded surface 68 of the retaining ring 66, could also be shot-peened.

Another modification to increase durability and loading capability of a threaded surface, such as the threaded surface 64 or the threaded surface 94, includes undercutting one or more roots of the threaded surface. Such undercutting may be used in addition to, or instead of the shot peening described above. In one embodiment generally depicted in FIG. 9, several roots 124 of the threaded surface 94 are undercut to change stress distribution in the drive stem 86 near the undercut roots 124. In FIG. 9, the first three roots 124 of the threaded surface 94 of the drive stem 86 (that is, the three roots 124 of the surface 94 furthest from the threaded end 96) are depicted as being undercut such that the these roots 124 have undercut surfaces 144, 146, and 148, respectively. This is in contrast to the roots 124 that have not been undercut (as generally represented by the other two roots 124 retaining the root radius 120 in FIG. 9). In some embodiments, like in FIG. 9, only a few roots 124 of the threadform are undercut, while the rest of the roots 124 are not undercut. But in other embodiments that have any undercutting, a different number of roots 124 may be undercut (e.g., as few as one or as many as all). The undercut surfaces 144, 146, and 148 may be undercut by the same amount or by different amounts. In one embodiment, the thread roots having undercut surfaces 144, 146, and 148 are also shot-peened. And while only a portion of the threaded surface 94 is depicted in FIG. 9 as having undercut roots 124, it is noted other threaded surfaces (e.g., surface 64 of the load nut 62) could also have undercut roots.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a top drive including:

a quill;

a load nut, wherein the load nut and the quill have mating threaded surfaces that enable the quill to be threaded through the load nut such that the quill extends through the load nut and to support weight of a drill string via the load nut; and a retaining ring having a threaded surface configured to mate with the mating threaded surface of the quill, wherein the load nut and the retaining ring are threaded onto the quill.

2. The system of claim 1, wherein the mating threaded surface of the quill has a threadform including at least one thread root that is undercut.

3. The system of claim 2, wherein the at least one thread root that is undercut is provided at an end of the mating threaded surface of the quill opposite an end of the quill having an additional threaded surface to engage the drill string.

4. The system of claim 1, wherein the mating threaded surfaces include buttress threads.

5. The system of claim 1, wherein at least one portion of one or both of the mating threaded surfaces of the quill and the load nut is shot-peened.

6. The system of claim 5, wherein a subset of roots of a threadform of the quill are shot-peened.

7. The system of claim 1, wherein the retaining ring includes attachment holes and the load nut includes attachment recesses to enable the retaining ring to be fastened to the load nut.

8. The system of claim 7, wherein the number of attachment holes in the retaining ring is greater than the number of attachment recesses in the load nut.

9. The system of claim 1, comprising a drilling rig including the top drive.

10. The system of claim 1, comprising the drill string.

11. A system comprising:

a quill of a top drive, the quill including:

a first threaded surface at an end of the quill configured to engage a drill string; and a second threaded surface that enables the quill, when installed in the top drive, to support one or more additional components of the top drive via a load nut threaded onto the second threaded surface, wherein the second threaded surface includes a thread profile having at least one thread root that is undercut and shot-peened;

the load nut; and a retaining ring having a threaded surface configured to mate with the second threaded surface of the quill, wherein the load nut and the retaining ring are threaded onto the second threaded surface of the quill.

12. The system of claim 11, wherein the at least one thread root that is undercut and shot-peened is positioned at an end of the second threaded surface opposite from the first threaded surface, and wherein the undercutting of the at least one thread root at the end of the second threaded surface reduces stress on the undercut at least one thread root.

13. The system of claim 11, wherein the one or more additional components of the top drive include an elevator and a drill string.

14. A method comprising:

installing a handling ring of a top drive about a quill of the top drive;

threading a load nut onto a threaded surface of the quill such that the quill extends through the load nut and weight of the handling ring is supported by threaded engagement of the load nut and the quill; and threading a retaining ring onto the same threaded surface of the quill as the load nut.

15. The method of claim 14, comprising shot-peening a thread root of the quill.

16. The method of claim 14, comprising undercutting a thread root of the quill.

* * * * *